United States Patent [19]

Yorita et al.

[11] Patent Number: 4,800,347

[45] Date of Patent: Jan. 24, 1989

[54] DIELECTRIC FILTER

[75] Inventors: Tadahiro Yorita; Motoharu Hiroshima, both of Kanazawa, Japan

[73] Assignee: Murata Manufacturing Co., Ltd., Japan

[21] Appl. No.: 92,769

[22] Filed: Sep. 3, 1987

[30] Foreign Application Priority Data

Sep. 4, 1986 [JP] Japan ..... 61-208759
Sep. 4, 1986 [JP] Japan ..... 61-208760
Sep. 4, 1986 [JP] Japan ..... 61-208761

[51] Int. Cl.[4] ..... H01P 1/205; H01P 7/04

[52] U.S. Cl. ..... 333/202; 333/203; 333/206; 333/222

[58] Field of Search ..... 333/202, 206, 207, 208, 333/209, 210, 212, 219, 222, 223, 235, 203

[56] References Cited

U.S. PATENT DOCUMENTS 4,423,396 12/1983 Makimoto et al. ..... 333/204
4,431,977 2/1984 Sokola et al. ..... 333/206
4,523,162 6/1985 Johnson ..... 333/202
4,692,726 9/1987 Green et al. ..... 333/207 X

FOREIGN PATENT DOCUMENTS 114902 7/1984 Japan ..... 333/202
60-254802 12/1985 Japan .
61-50223 3/1986 Japan .

OTHER PUBLICATIONS

Hägele—"Mikrowellenfilter mit Umwegkopplungen sur Erzeugung von Dämpfungspolen," Frequenz, 24 (1970) 11; pp. 330–331.

*Primary Examiner*—Marvin L. Nussbaum
*Attorney, Agent, or Firm*—Ostrolenk, Faber, Gerb & Soffen

[57] ABSTRACT

A dielectric filter includes a single block made of dielectric material having three or more through holes, in each of which an inner conductor is deposited, to define three or more dielectric resonators coupled in a cascade manner. Coupling holes are each formed between a pair of neighboring dielectric resonators. A bypass circuit, having a reactance component, is provided for connecting between two or more coupling holes; or for connecting the through hole of the dielectric resonator and a coupling hole; or for connecting the input terminal and one or more through holes of the dielectric resonators or the coupling holes. By selecting the holes to be interconnected and the value of the reactance of the bypass circuit, it is possible to provide a filter having a frequency characteristic in a desired format, including at least one pole at a selected point in an attenuation region thereof, without any increase in the number of dielectric resonator stages of the dielectric filter.

8 Claims, 14 Drawing Sheets

DIELECTRIC FILTER

CROSS REFERENCE TO A RELATED APPLICATION

This application is related to U.S. patent application Ser. No. 913,095, filed Sept. 29, 1986, and now U.S. Pat. No. 4,740,765, which is assigned to the same assignee as the present application.

BACKGROUND OF THE INVENTION

1. Field of the Invention

This invention relates to a dielectric filter comprising a plurality of dielectric resonators of which adjacent ones are connected to each other electromagnetically or via a coupling element. More particularly, the present invention relates to a band-pass type dielectric filter having a pole in an attenuation region.

2. Description of the Prior Art

In a band-pass filter, it is sometimes requested by a user than an excellent frequency attenuation should be obtained in a certain region that is separated from the center frequency by a certain degree. To accomplish the aforesaid request, in a dielectric filter comprising a plurality of resonators, whether cavity or dielectric type, of which adjacent ones are connected to each other electromagnetically or via a coupling element, one method is to increase the number of resonator stages.

However, when the number of the resonator stages increases, the filter itself becomes bulky and expensive. Also, as the number of stages increases, the resonant frequency of the $TE_{11}$ mde shifts towards the lower frequency region close to the resonant frequency of the wanted mode, TEM mode. Therefore, the $TE_{11}$ mode will be rendered as the spurious mode.

SUMMARY OF THE INVENTION

The present invention has been developed with a view to substantially solving the above described disadvantages and has for its essential object to provide an improved dielectric filter which can provide a pole or poles in a frequency region adjacent the center frequency. Thus, it is possible to provide a band-pass filter, having a frequency characteristic in a desired format without any increase in the number of stages of the dielectric resonators.

It is also an essential object of the present invention to provide an improved dielectric filter of the above described type which can be easily manufactured.

In accomplishing these and other objects, a dielectric filter according to the present invention comprises a single block made of dielectric material having three or more through holes in which an inner conductor is deposited to define three or more dielectric resonators coupled in a cascade manner, and coupling holes each formed between neighboring dielectric resonators. A bypass circuit, having a reactance component, is provided for connecting between two or more coupling holes, or for connecting the through hole of a dielectric resonator and a coupling hole, or for connecting the input terminal at least to within the through hole of a dielectric resonator or a coupling hole. By selecting the value of the reactance of the bypass circuit, it is possible to provide a filter having a frequency characteristic in a desired format, including at least one pole at a selected point in an attenuation region thereof, without any increase in the number of stages of the dielectric resonators.

BRIEF DESCRIPTION OF THE DRAWINGS

These and other objects and features of the present invention will become apparent from the following description of preferred embodiments thereof with reference to the accompanying drawings, throughout which like parts are designated by like reference numerals, and in which.

DETAILED DESCRIPTION OF THE EMBODIMENTS OF THE INVENTION

First Embodiment

Figure 1:
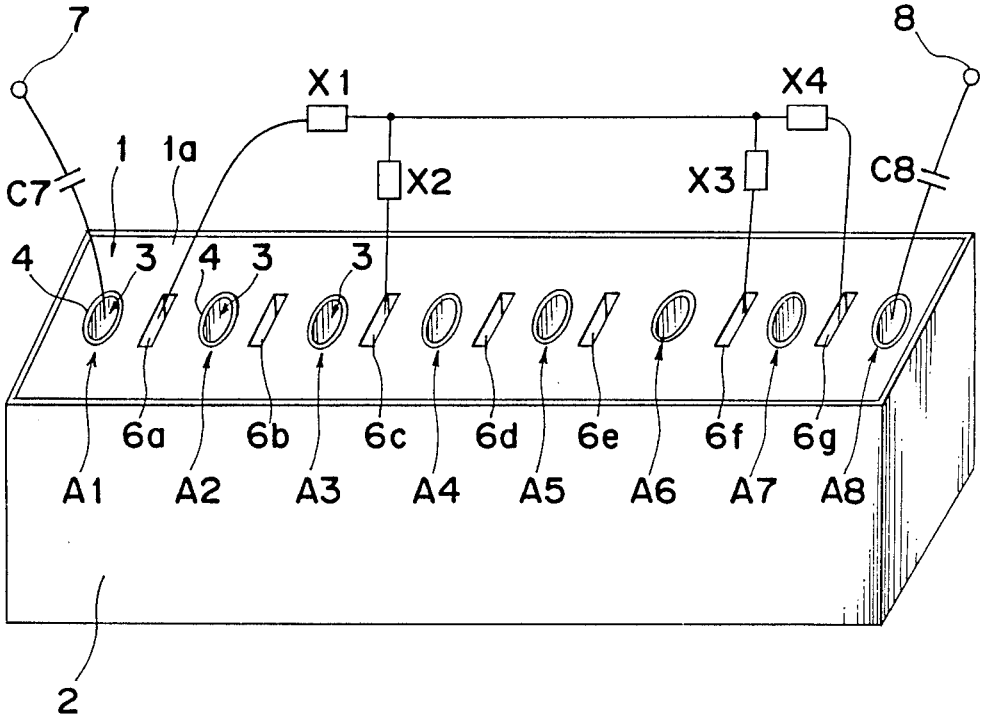
FIG. 1 is a perspective view of a dielectric filter according to a first embodiment of the present invention.
Figure 2:
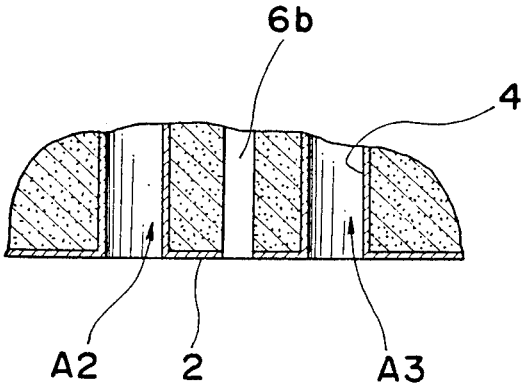
FIG. 2 is a fragmentary cross-sectional view of the dielectric filter of FIG. 1, particularly showing a bottom portion thereof.
Figure 11:
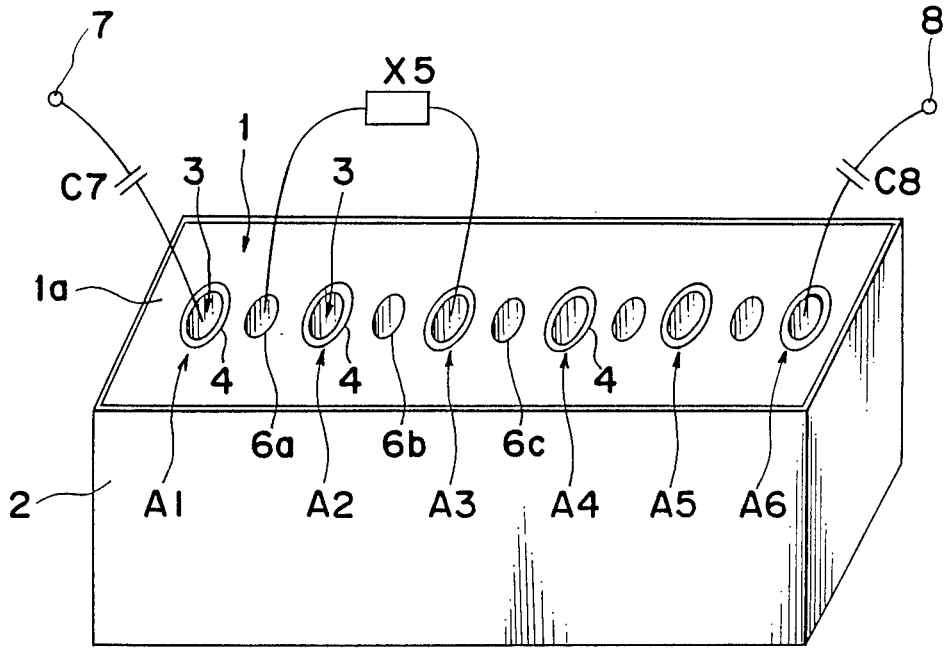
FIG. 11 is a perspective view of a dielectric filter according to a second embodiment of the present invention.

FIG. 1 shows a first embodiment of the present invention in which a dielectric filter comprises a block of dielectric resonators. Reference numeral 1 designates a block made of dielectric material, for example, consisting of a ceramic dielectric of the titanium oxide group. An outer conductor 2 made of metal film is formed on all four sides of block 1 wherein through-holes 3 are formed at a certain interval. An inner conductor 4 of metal film is formed on the inner wall of holes 3, and it is shortcircuited to the outer conductor 2 via a conductive film formed on the bottom of the block 1 (FIG. 2). The bottom of the dielectric block is referred to as "short-circuit end face", and the top face 1a of the same where no conductive film is formed, is referred to as an "open end face". Dielectric resonators A1, A2, ..., A8 are thereby formed, each comprising inner conductor 4, outer conductor 2 and the dielectric block portion provided around the conductor 4. According to the embodiment shown in FIG. 1, the number of the dielectric resonators is eight, but can be any number greater than three. Between each neighboring pair of the resonators, e.g., A1 and A2, a coupling element, such as a coupling hole 6*a*, is formed for coupling the neighboring resonators, whereby adjacent resonators A1 and A2 are coupled to each other electromagnetically. In FIG. 1, the coupling hole 6*a* is shown as having a rectangular cross-section, but it can be a circle cross-section, as shown in FIG. 11. Also, the coupling holes may be extended completely through block 1 or may be extended intermediately part-way through block 1.

The above described arrangement is known in the art, such as disclosed in Japanese Patent Laid-Open Publication No. 60-254802 published December 16, 1985 and assigned to the same assignee as the present application. Also, other types of dielectric filters may be used, such as disclosed in U.S. Pat. Nos. 4,523,162 and 4,431,977 and in Japanese Patent Laid-Open Publication No. 61-52003.

According to the first embodiment, two or more coupling holes 6*a*, 6*c*, 6*f* and 6*g* are electrically connected to each other through reactance elements X1, X2, X3 and X4.

Generally in this specification, the electrical connection with respect to the coupling hole is accomplished by inserting an electrically conductive material in the coupling hole.

Each reactance element is formed either by a capacitor or by an inductor, or by a combination of the capacitor and inductor. Also, each reactance element can be either a lumped component type or a distributed component type, as long as the element is equivalent to a reactance. Which of the coupling holes are to be electrically connected through reactance elements can be determined according to the required filter characteristic.

As shown in FIG. 1, an input terminal 7 is connected through a capacitor C7 to inner conductor 4 of the first resonator A1, and an output terminal 8 is connected through a capacitor C8 to inner conductor 4 of the last resonator A8. The input and output terminals 7 and 8 can also be used in an opposite manner as output and input terminals, respectively.

Figure 3:
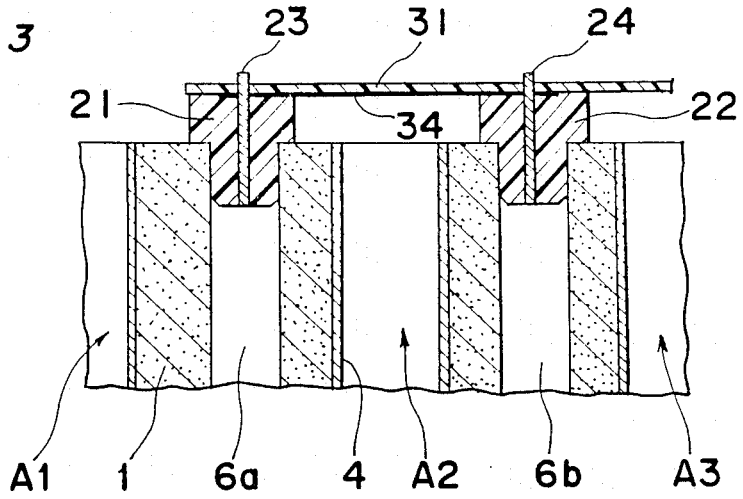
FIG. 3 is a fragmentary cross-sectional view of the dielectric filter of FIG. 1, particularly showing an arrangement of a bypass circuit.

Referring to FIG. 3, an example of a connector for electrically connecting the coupling holes 6*a* and 6*b* through capacitive reactance elements is shown. In FIG. 3, a synthetic resin bushing 21, made of a synthetic resin having a dielectric property, is fittingly inserted into coupling hole 6*a* from the open end face 1*a* and, similarly, another synthetic resin bushing 22 is fittingly inserted into coupling hole 6*b*. Each synthetic resin bushing is carrying a metallic pin 23, 24 rigidly inserted therethrough with one end projecting outwardly from the synthetic resin bushing. The projecting ends of pins 23 and 24 are electrically connected to each other by a printed circuit board 31.

Figure 4:
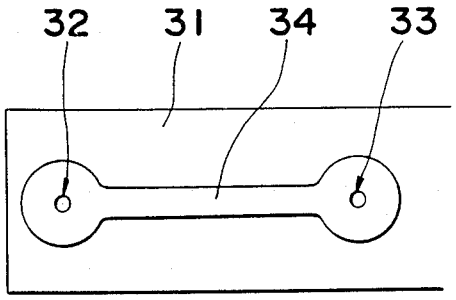
FIG. 4 is a top plan view of a printed circuit used in the bypass of circuit Fig.

As shown in FIG. 4, printed circuit board 31 is formed by a dielectric plate, such as a Teflon or glass material, and an electrode 34 deposited thereon and extending between through-holes 32 and 33. Through-holes 32 and 33 are provided for receiving the projecting ends of pins 23 and 24. By the above arrangement, a capacitive reactance element is formed between the metallic pin and the inner conductor 4 or the adjacent resonators. For example, the capacitive reactance can be observed between the inner conductor 4 of resonator A1 and metallic pin 23 and also between the inner conductor 4 of resonator A2 and metallic pin 23. The reactance amount of the reactance element is determined by various factors, such as the depth of insertion of the metallic pin, dielectric constant of the synthetic resin bushing, etc.

The example shown in FIG. 3 is a case when the coupling holes on the opposite sides of a resonator A2 are electrically connected by the printed circuit board 31, but any other combination of coupling holes, which may be two or more, can be electrically connected by a similar printed circuit board. Also, in the case where the coupling holes are through-holes, the bushings carrying the metallic pins can be inserted from the short-circuit end face.

Figure 5:
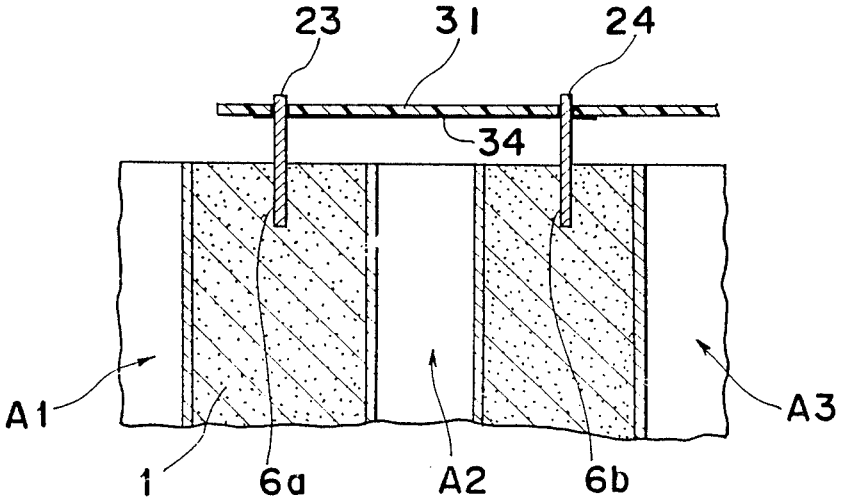
FIG. 5 is a fragmentary cross-sectional view, particularly showing a modification of the arrangement shown in FIG. 3.

Referring to FIG. 5, a modification of the coupling element is shown. Instead of using the synthetic resin bushings 21 and 22 inserted in coupling holes, the metallic pins 23 and 24 are mounted directly in block 1.

Figure 6:
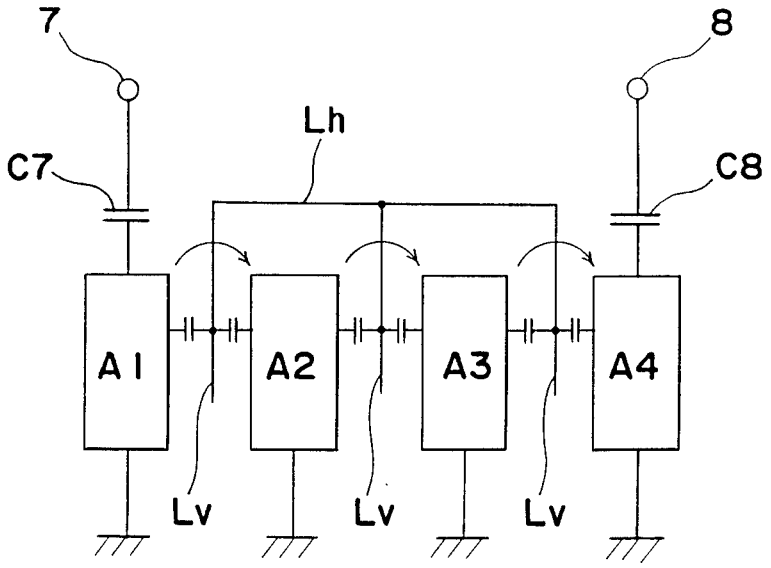
FIG. 6 is an equivalent circuit of a dielectric filter according to another modification of the first embodiment.

Referring to FIG. 6, an equivalent circuit of a dielectric filter according to another modification of the first embodiment is shown. In this modification, there are four resonators A1, A2, A3 and A4 which are electromagnetically connected to each other as indicated by arrows. In FIG. 6 and in other similar drawings, a space between two adjacent resonators represents the coupling hole, and a vertical line Lv extending in the space represents the metallic pin. Also, a horizontal line Lh connecting the vertical lines Lv represents the electrode on the printed circuit board. The capacitors extending from each vertical line Lv indicate the capacitive reactances observed between the metallic pin and the inner conductors of adjacent resonators. Although not shown in FIG. 6. there may be some inductive reactance observed along the line Lh.

The operation of the dielectric filter of FIG. 6 will now be explained. A high frequency signal applied to input terminal7 is tranmitted through capacitor C7, and is filtered through the first resonator A1. Mainly, the filtered signal is transmitted in the direction of the arrow to the second resonator A2, and in turn, to the third and fourth resonators A3 and A4. Finally, the filtered signal from resonator A4 is transmitted through capacitor C8 to output terminal 8. At the same time, the filtered signal from resonator A1 is partly transmitted through a bypass circuit defined by lines Lv and Lh, that is, by the metallic pin and the printed circuit. In the circuit of FIG. 6; there are three bypass circuits: A1-Lv-Lh-A3; A1-Lv-Lh-A4; and A2-Lv-Lh-A4. According to the first embodiment, at least one bypass circuit is provided that extends from one coupling element to another coupling element.

Figure 7:
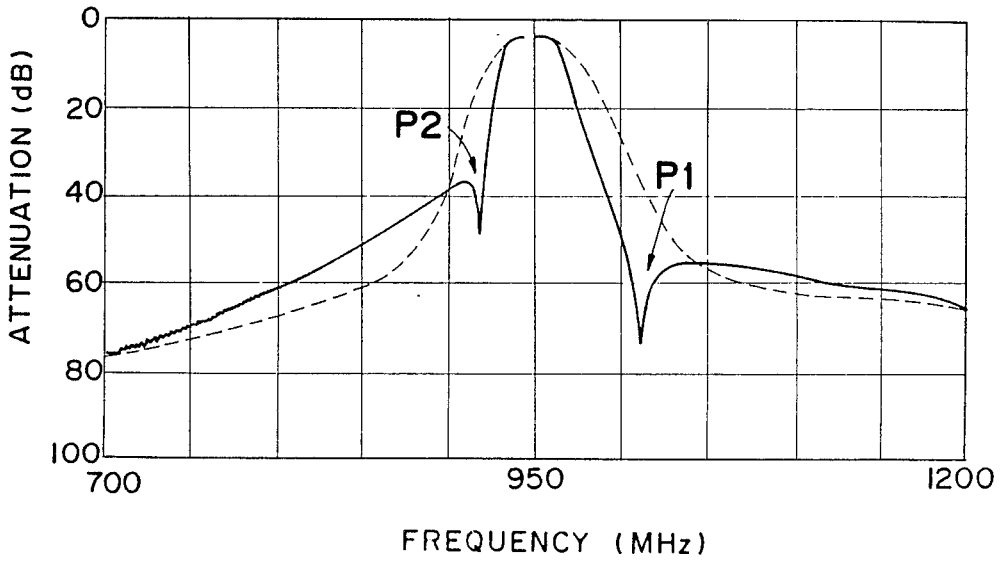
FIG. 7 is a graph showing a frequency characteristic of the dielectric filter of FIG. 6.

A frequency characteristic of the dielectric filter shown in FIG. 6 is given in FIG. 7. In the graph of FIG. 7, the dotted line represents the frequency characteristic of the dielectric filter of FIG. 6, but without any bypass circuit, and the solid line with poles P1 and P2 represents the frequency characteristic of the dielectric filter of FIG. 6 with the bypass circuits as explained above. As apparent from the graph, poles P1 and P2 appear in the regions above and below the center frequency so that an excellent frequency attenuation can be obtained in the regions above and below the center frequency. The position of the poles P1 and P2 can be adjusted by changing the reactance amount along the bypass circuit and also by changing the number and the connection of the bypass circuit.

The reason why the poles P1 and P2 appear may be explained as follows. When the high frequency signal is transmitted through the bypass circuit, the phase of the high frequency signal for a particular frequency is shifted 180° by the reactance element. Therefore, when the high frequency signal transmitted through the main pass (A1-A2-A3-A4), and the high frequency signal transmitted through the bypass circuit, are combined at the end of the bypass circuit, the 180° shifted high frequency signal from the bypass circuit counteracts the high frequency signal in the main pass. Therefore, the high frequency signal of that particular frequency is attenuated to produce the pole.

Figure 8:
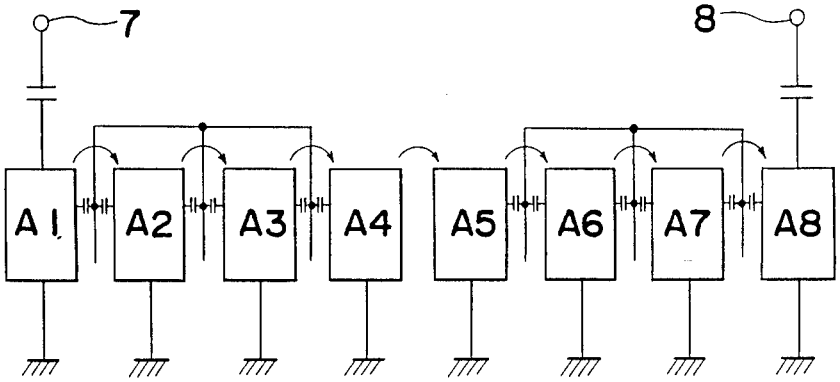
FIGS. 8, 9 and 10 are circuit diagrams similar to FIG. 6, but particularly showing modifications thereof.
Figure 9:
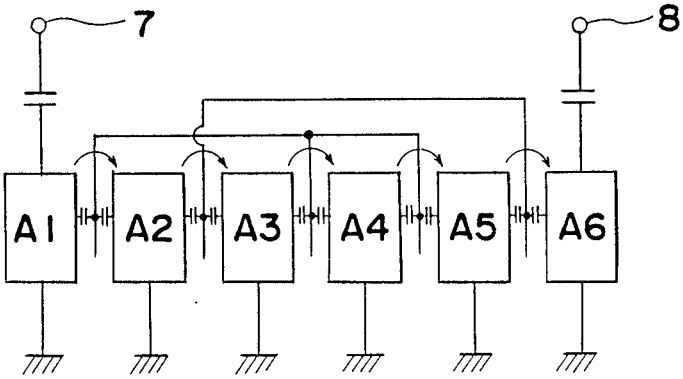
Figure 10:
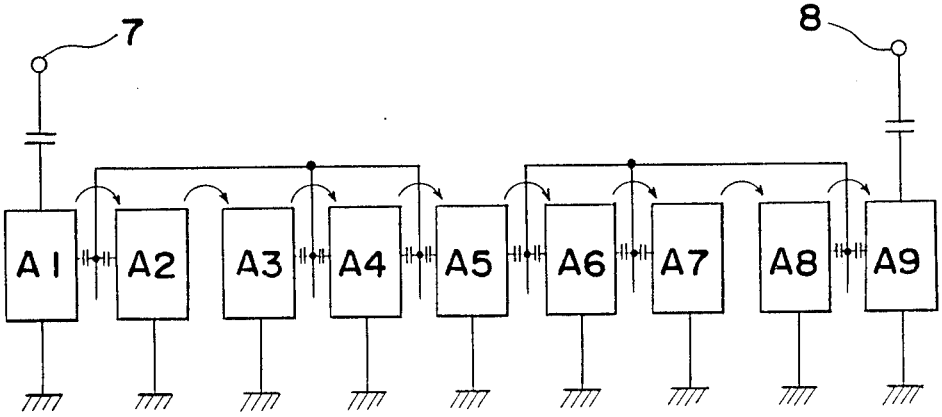

Referring to FIGS. 8, 9 and 10, equivalent circuits of a dielectric filter according to further modifications of the first embodiment are shown. Specially, FIG. 8 shows a case where a group of bypass circuits are formed at one end portion of the aligned resonators, and another group of bypass circuits are formed at the other end of the aligned resonators. FIG. 9 shows a case where two groups of bypass circuits are provided with interleaving. FIG. 10 shows a case where the metallic pins are inserted in the copuling holes with some holes being skipped.

In any one of the above described modifications, poles P1 and P2 appear in the region above and below the center frequency so that an excellent frequency attenuation can be obtained in such regions. Also, the number of poles may be changed depending on the structure of the bypass circuits.

Second Embodiment

Referring to FIG. 11, a second embodiment of the present invention is shown in which the dielectric filter employed therein is very similar to that shown in FIG. 1, but differs in that each coupling hole has a circle configuration, and that the number of resonators aligned is six.

According to the second embodiment, at least one coupling hole 6*a* is electrically connected through a reactance element X5 to at least one dielectric resonator A3 which is other than a resonator located immediately adjacent said coupling hole 6*a*.

Generally in this specification, the electrical connection with respect to the resonator is accomplished by an electrical connection of a line to the inner conductor 4 of the resonator.

Like the first embodiment, each reactance element is formed either by a capacitor or by an inductor, or by a combination of the capacitor and inductor.

Figure 12:
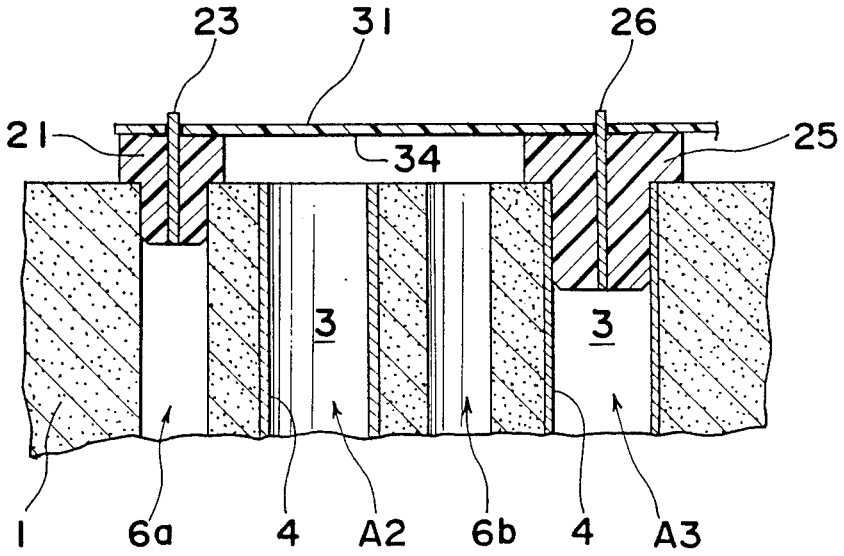
FIG. 12 is a fragmentary cross-sectional view of the dielectric filter of FIG. 11, particularly showing an arrangement of a bypass circuit.

Referring to FIG. 12, an example of a connector for electrically connecting the coupling hole 6a and dielectric resonator A3 through capacitive reactance elements is shown. In FIG. 3, a synthetic resin bushing 21, made of a synthetic resin having a dielectric property, is fittingly inserted into coupling hole 6*a* from the open end face 1*a* and, similarly, another synthetic resin bushing 25 is fittingly inserted into through-hole 3 of dielectric resonator A3. Each synthetic resin bushing is carrying a metallic pin 23, 26 rigidly inserted therethrough with one end projecting outwardly from the synthetic resin bushing. The projecting ends of pins 23 and 26 are electrically connected to each other by a printed circuit board 31 which is similar to the one shown in FIG. 4.

By the above arrangement, the capacitive reactance components can be obtained between the metallic pin 23 and the inner conductor 4 of the adjacent resonators. For example, the capacitive reactance can be observed between the inner conductor 4 of resonator A1 and metallic pin 23 and also between the inner conductor 4 of resonator A2 and metallic pin 23. Furthermore, the capacitive reactance component can be obtained between the metallic pin 26 and the inner conductor 4 of resonator A3.

Figure 13:
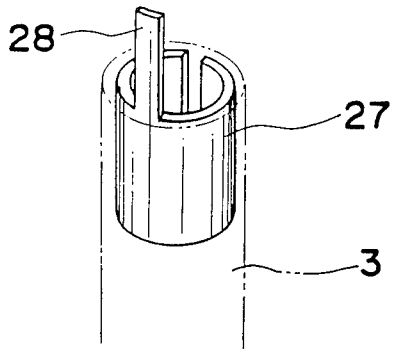
FIG. 13 is a perspective view of a cylindrical pin used for connecting the bypass circuit in a modification of FIG. 12.

Instead of using a bushing carrying the metallic pin, such as the one inserted in the resonator A3, it is possible to use a metallic cylindrical pin, such as shown in FIG. 13. The cylindrical pin shown in 13 comprises a cylindrical portion 27 which is inserted into the through-hole 3 for direct electric contact with the inner conductor 4, and a projection portion 28 which is provided for the electrical connection with the printed circuit board.

Figure 14:
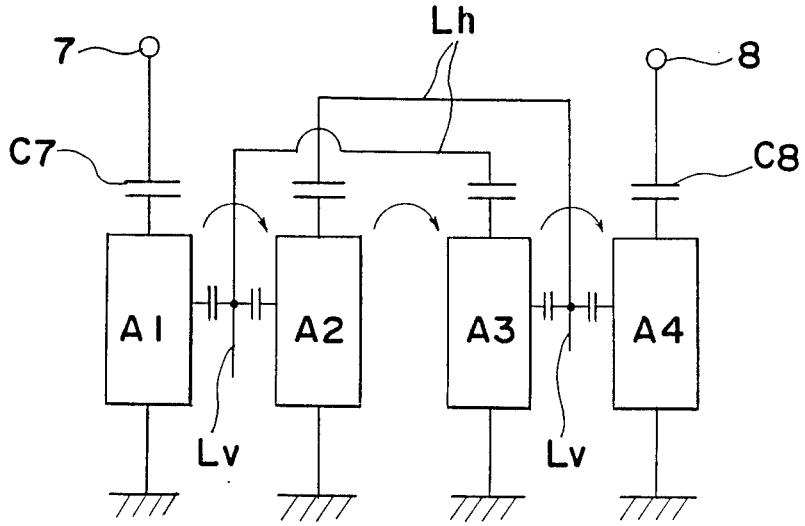
FIG. 14 is an equivalent circuit of a dielectric filter according to another modification of the second embodiment.

Referring to FIG. 14, an equivalent circuit of a dielectrid filter according to one modification of the second embodiment is shown. In this modification, there are four resonators A1, A2, A3 and A4 which are electromagnetically connected to each other as indicated by arrows. Like the first embodiment, the capacitors extending from each vertical line Lv indicate the capacitive reactances observed between the metallic pin and the inner conductors of adjacent resonators. Also, the capacitors connected on top of each of resonators A2 and A3 are the capacitive reactances observed between the metallic pin and the inner conductor 4.

The operation of the dielectric filter of FIG. 14 is similar to that explained above in connection with FIG. 6. A high frequency signal applied to input terminal 7 is transmitted through capacitor C7, and is filtered through the first resonator A1. Mainly, the filtered signal is transmitted in the direction indicated by arrows through the second, third and fourth resonators, and in turn, the filtered signal is transmitted through capacitor C8 to output terminal 8. At the same time, the filtered signal from resonator A1 is partly transmitted through a bypass circuit defined by lines Lv and Lh. In the circuit of FIG. 14, there are two bypass circuits: A1-Lv-Lh-A3; and A2-Lh-Lv-A4. According to the second embodiment, at least one bypass circuit is provided that extends from one coupling element to one resonator.

Figure 15:
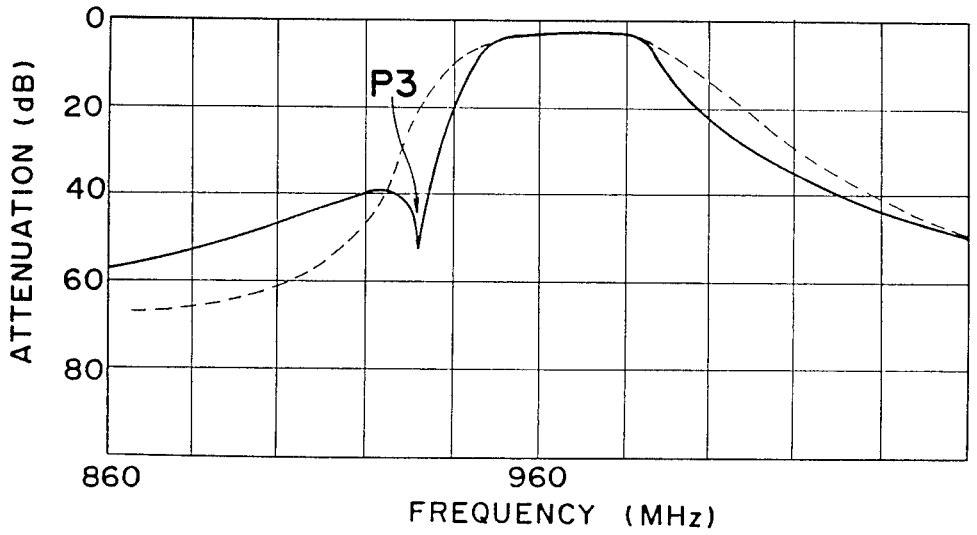
FIG. 15 is a graph showing a frequency characteristic of the dielectric filter of FIG. 14.

A frequency characteristic of the dielectric filter shown in FIG. 14 is given in FIG. 15. In the graph of FIG. 15, the dotted line represents the frequency characteristic of the dielectric filter of FIG. 14, but without any bypass circuit, and the solid line with a pole P3 represents the frequency characteristic of the dielectric filter of FIG. 14 with the bypass circuits as explained above. As apparent from the graph, pole P3 appears in the region below the center frequency so that an excellent frequency attenuation can be obtained in the region below the center frequency. The position of the pole P3 can be adjusted by changing the reactance amount along the bypass circuit and also by changing the number and the connection of the bypass circuit.

The same reason as explained above can be applied to explain why the pole P3 appears.

Figure 16:
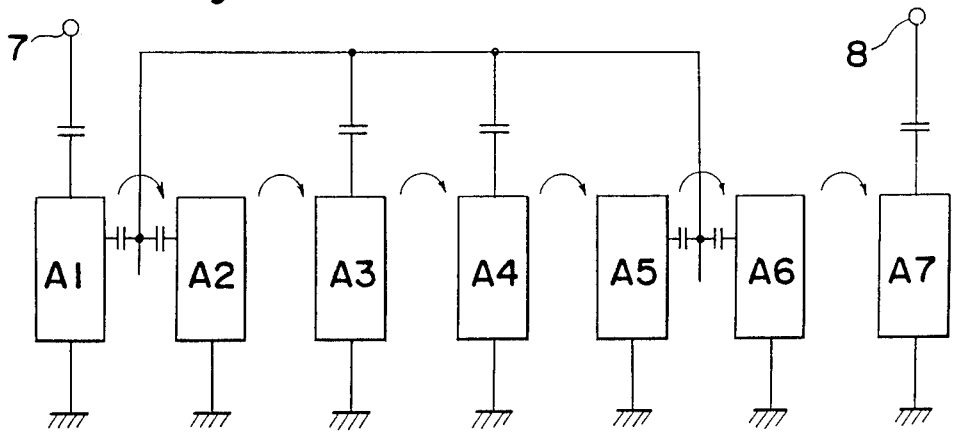
FIGS. 16, 17, 18, 19 and 20 are circuit diagrams similar to FIG. 14, but particularly showing modifications thereof.
Figure 17:
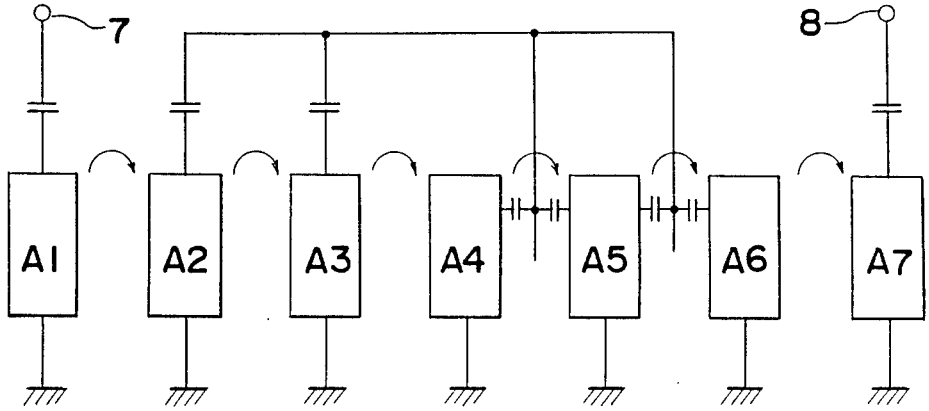
Figure 18:
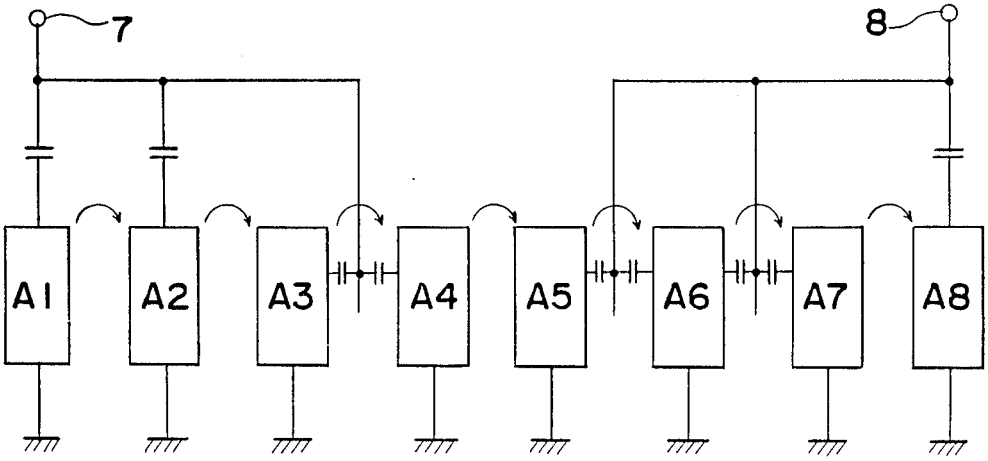
Figure 19:
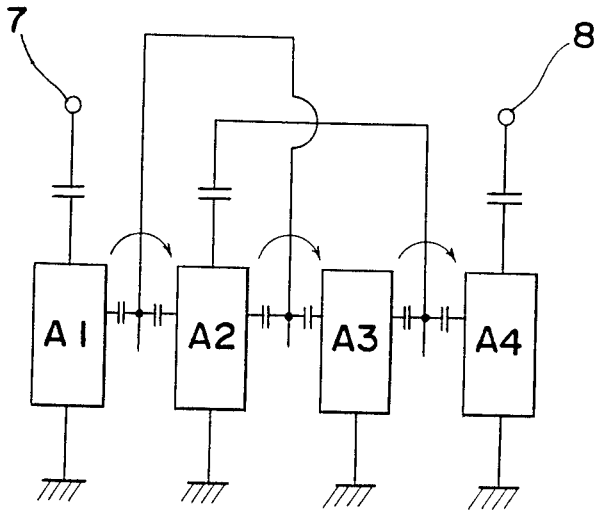
Figure 20:
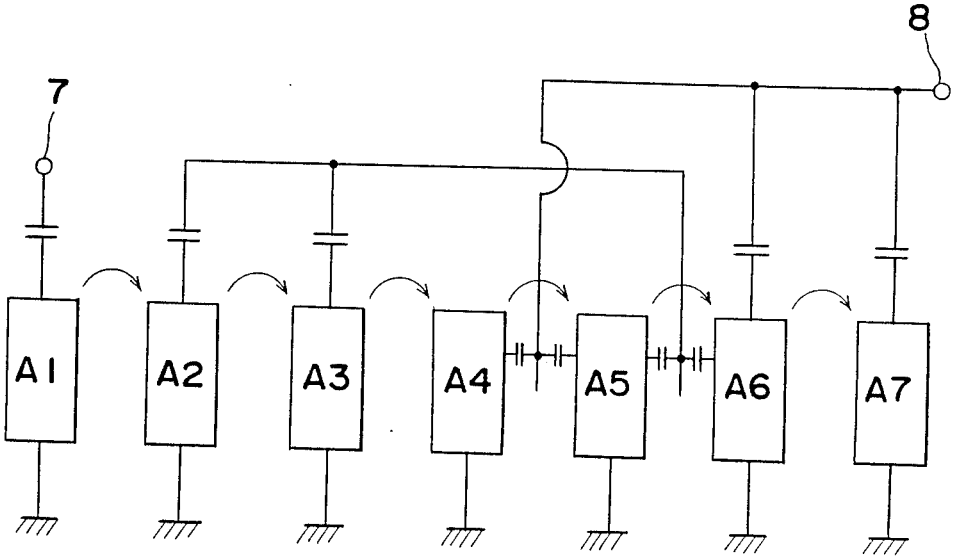

Referring to FIGS. 16, 17, 18, 19 and 20, equivalent circuits of a dielectric filter according to further modifications of the second embodiment are shown. Specially, FIG. 16 shows a case where a group of bypass circuits (A1–A3, A1–A4, A1–A6, A3–A4, A3–A6 and A4–A6) are formed using one horizontal line Lh. FIG. 17 sohws a similar connection of bypass circuits. FIG. 18 shows a case where two groups of bypass circuit are provided, respectively, at opposite ends of the aligned resonators, and FIGS. 19 and 20 show cases where two groups of bypass circuits are provided with interleaving between the two groups. Particularly, FIG. 19 shows a case wherein one bypass circuit electrically connects between two coupling holes and another bypass circuit electrically connects a coupling hole and a resonator.

In any one of the above described modifications, one or more poles appear in the regions above and/or below the center frequency so that an excellent frequency attenuation can be obtained in such regions. Also, the number of poles may be changed depending on the structure of the bypass circuits.

Figure 21A:
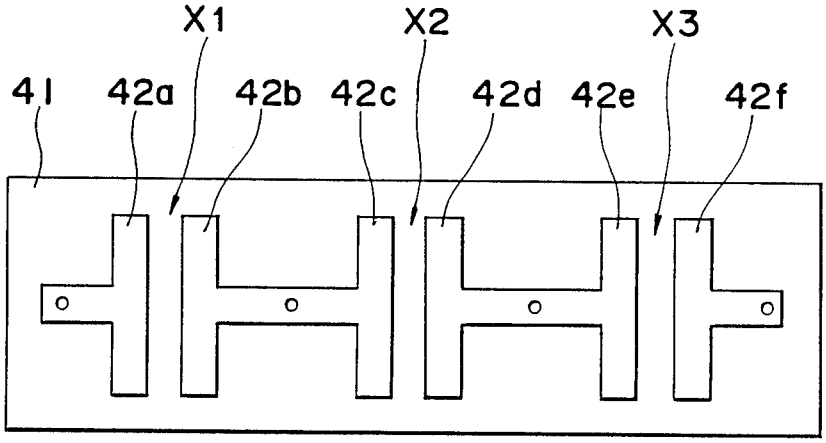
FIG. 21*a* is a top plan view of a printed circuit board provided with capacitive reactance elements.
Figure 21B:
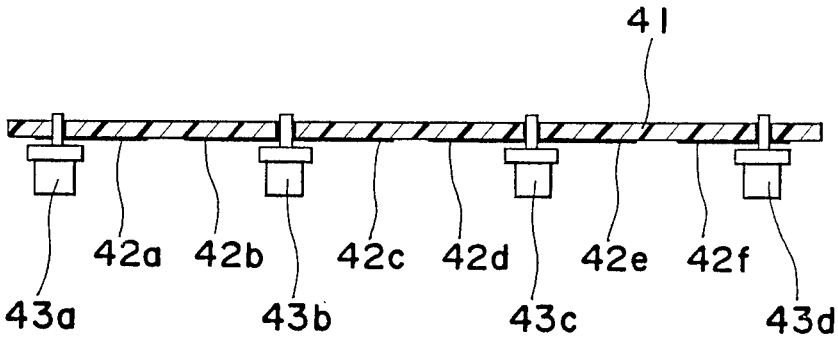
FIG. 21*b* is a side view showing the printed circuit board of FIG. 21*a* provided with cylindrical pins.

Referring to FIG. 21*a*, an electrode pattern to be formed on the printed circuit is shown for forming capacitive elements X1, X2 and X3 between parallel extended electrodes 42*a* and 42*b*, between electrodes 42*c* and 42*d*, and between electrodes 42*e* and 42*f*. As seen in FIGS. 21*a* and 21*b*, electrode 42*a* is connected to cylindrical pin 43*a*, electrodes 42*b* and 42*c* are connected to cylindrical pin 43*b*, electrodes 42*d* and 42*e* are connected to cylindrical pin 43*c*, and electrode 42*f* is connected to cylindrical pin 43*d*.

In the arrangement shown in FIG. 21*b*, instead of using cylindrical pins, it is possible to use synthetic resin bushings carrying metallic pins, such as shown in FIG. 12.

Third Embodiment

Figure 22:
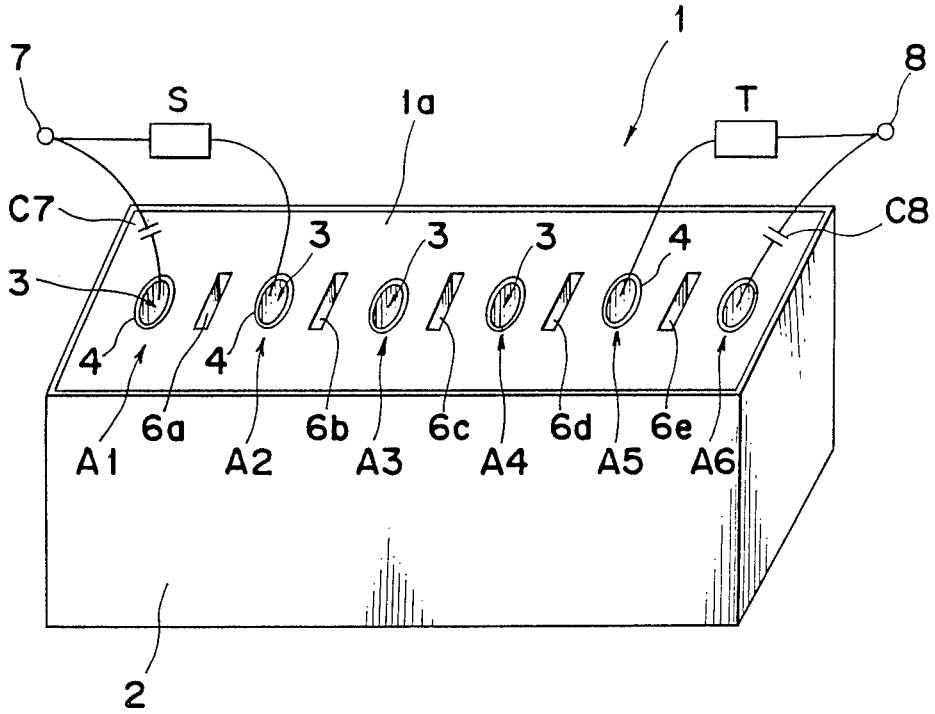
FIG. 22 is a perspective view of a dielectric filter according to a third embodiment of the present invention.

Referring to FIG. 22, a third embodiment of the present invention is shown in which the dielectric filter employed therein is very similar to that shown in FIG. 1, but differs in that the number of resonators aligned is six.

According to the third embodiment shown in FIG. 22, input terminal 7 is electrically connected through a reactance element S to one dielectric resonator A2 which is other than the ones located at opposite ends of the resonator alignment. Like other embodiments, input terminal 7 is also connected to the first dielectric resonator A1 through coupling capacitor C7.

Furthermore, output terminal 8 is electrically connected through a reactance element T to one dielectric resonator A5 which is other than the ones located at opposite ends of the resonator alignment. Like other embodiments, output terminal 8 is also connected to the last dielectric resonator A6 through coupling capacitor C8.

Like the first embodiment, each reactance element S or T is formed either by a capacitor or by an inductor, or by a combination of a capacitor and an inductor.

Figure 23:
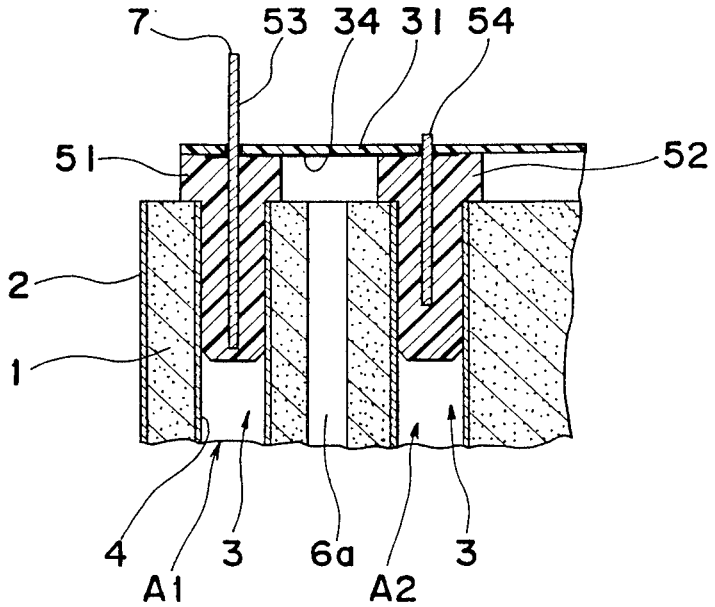
FIG. 23 is a fragmentary cross-sectionalview of the dielectric filter of FIG. 22, particularly showing an arrangement of a bypass circuit extending from an input terminal.

Referring to FIG. 23, an example of a connector for electrically connecting the input terminal 7 to dielectric resonators A1 and A2 through capacitive reactance elements is shown. In FIG. 23, a synthetic resin bushing 51, made of a synthetic resin having a dielectric property, is fittingly inserted into through-hole 3 of dielectric resonator A1 from the open end face 1*a* and, similarly, another synthetic resin bushing 52 is fittingly inserted into through-hole 3 of dielectric resonator A2. Each synthetic resin bushing is carrying a metallic pin 53, 54 rigidly inserted therethrough with one end projecting outwardly from the synthetic resin bushing. The projecting ends of pins 53 and 54 are electrically connected to each other by a printed circuit board 31 which is similar to the one shown in FIG. 4.

By the above arrangement, the coupling capacitor C7 can be obtained between the metallic pin 53 and the inner conductor 4 of resonator A1, and the capacitive reactance component S can be obtained between the metallic pin 54 and the inner conductor 4 of resonator A2. A similar arrangement can be employed for the output terminal 8.

Figure 24:
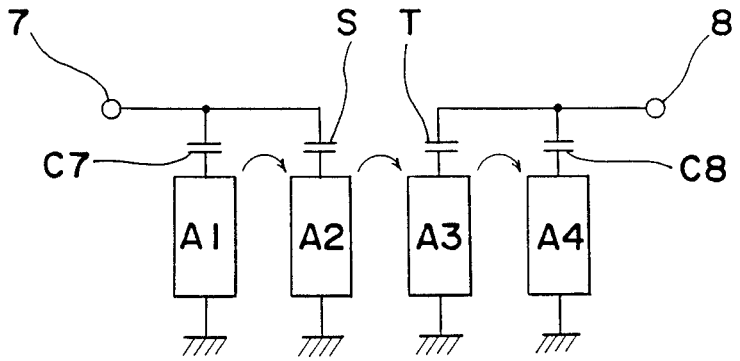
FIG. 24 is an equivalent circuit of a dielectric filter according to a modification of the third embodiment of FIG. 22.

Referring to FIG. 24, an equivalent circuit of a dielectric filter according to one modification of the third embodiment is shown. In this modification, there are four resonators A1, A2, A3 and A4 which are electromagnetically connected to each other as indicated by arrows. The capacitors S and T connected on top of each of resonators A2 and A3 are the capacitive reactances observed between the metallic pin and the inner conductors 4.

The operation of the dielectric filter of FIG. 24 is similar to that explained above in connection with FIG. 6. A high frequency signal applied to input terminal 7 is transmitted through capacitor C7, and is filtered through the first resonator A1. Mainly, the filtered signal is transmitted in the direction indicated by arrows through the second, third and fourth resonators, and in turn, the filtered signal is transmitted through capacitor C8 to output terminal 8. At the same time, the filtered signal from input terminal 7 is partly transmitted through a bypass circuit defined by reactance S. According to the third embodiment, at least one bypass circuit is provided that extends from input terminal 7 through a reactance element S to one resonator located between the opposite end resonators, or to one coupling element. Also preferably, at least one bypass circuit is provided that extends from output terminal 8 through a reactance element T to one resonator located between the opposite resonators, or to one coupling element.

Figure 25:
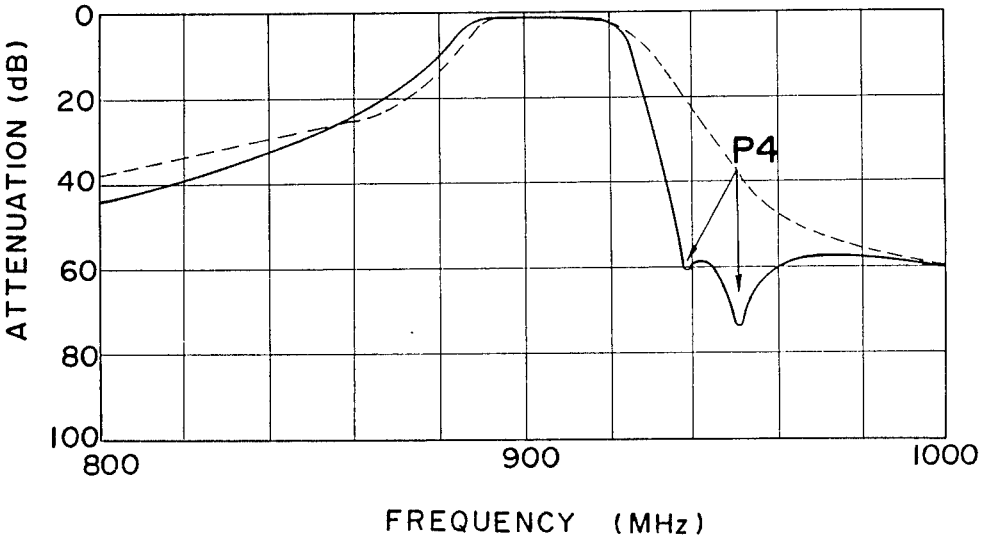
FIG. 25 is a graph showing a frequency characteristic of the dielectric filter of FIG. 24.

A frequency characteristic of the dielectric filter shown in FIG. 24 is given in FIG. 25. In the graph of FIG. 25, the dotted line represents the frequency characteristic of the dielectric filter of FIG. 24, but without any bypass circuit, and the solid line with poles P4 represents the frequency characteristic of the dielectric filter of FIG. 24 with the bypass circuits as explained above. As apparent from the graph, poles P4 appear in the region above the center frequency so that an excellent frequency attenuation can be obtained in the region above the center frequency. The position of the poles P4 can be adjusted by changing the reactance amount along the bypass circuit and also by changing the number and the connections of the bypass circuits.

The same reason as explained above can be applied to explain why the poles P4 appear.

Referring to FIGS. 26, 27, 28 and 29, equivalent circuits of a dielectric filter according to further modifications of the third embodiment are shown.

Figure 26:
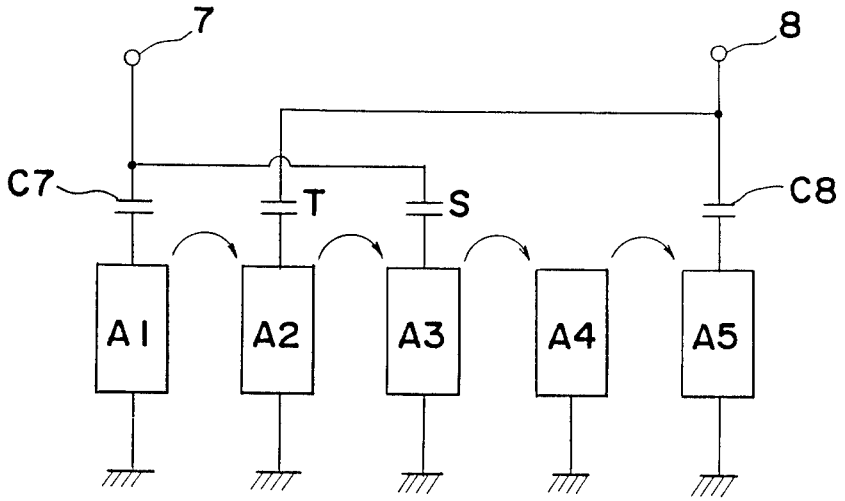
FIGS. 26, 27, 28 and 29 are circuit diagrams similar to FIG. 24, but particularly showing modifications thereof.

FIG. 26 shows a case where the first bypass circuit from the input terminal 7 extends to resonator A3 and the second bypass circuit from the output terminal extends to resonator A2 so that the first and second bypass circuits are interleaved with one another.

Figure 27:
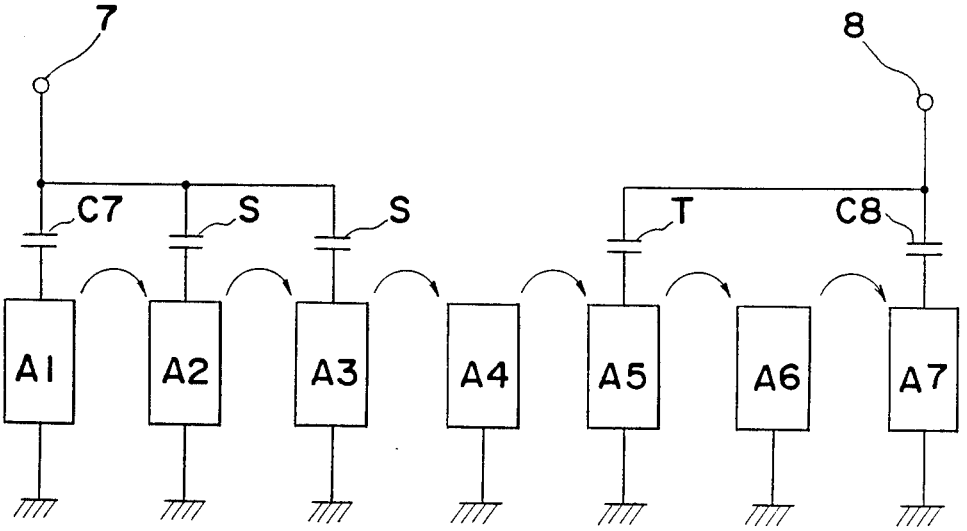
Figure 28:
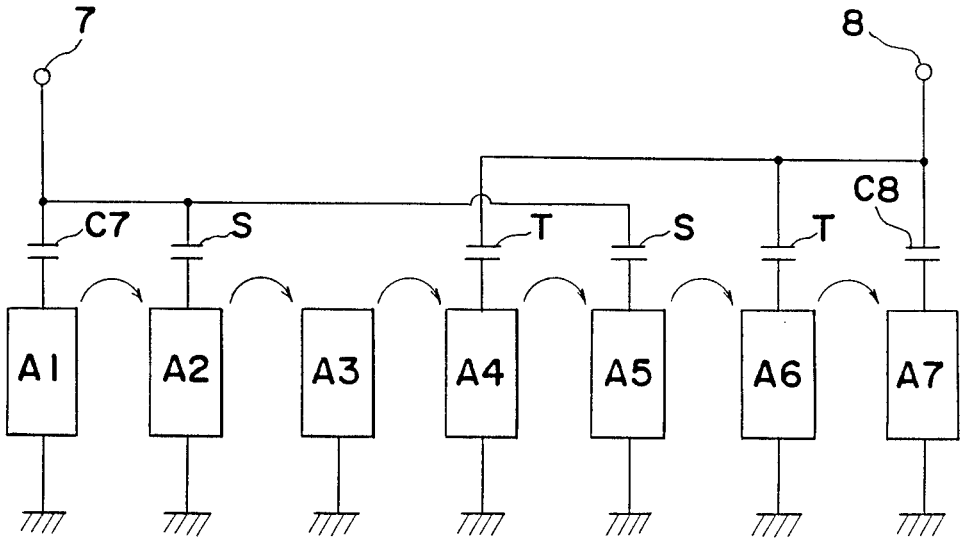

FIG. 27 shows a case where a number of bypass circuits are formed from the input terminal 7. FIG. 28 shows a case where a number of bypass circuits are formed from the input terminal 7 and also from the output terminal 8, and also the bypass circuits are interleaved with one another.

Figure 29:
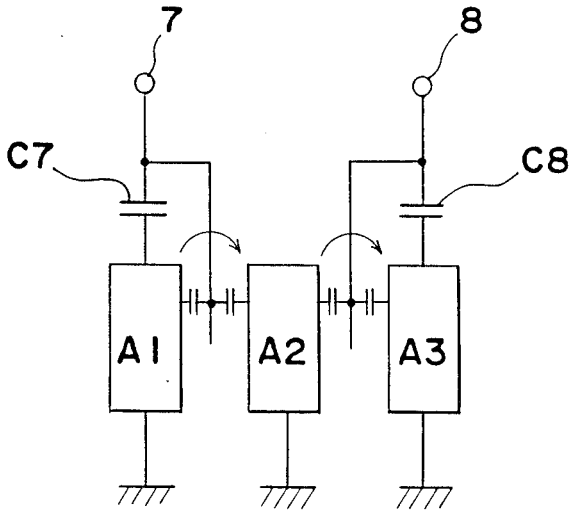
Figure 30:
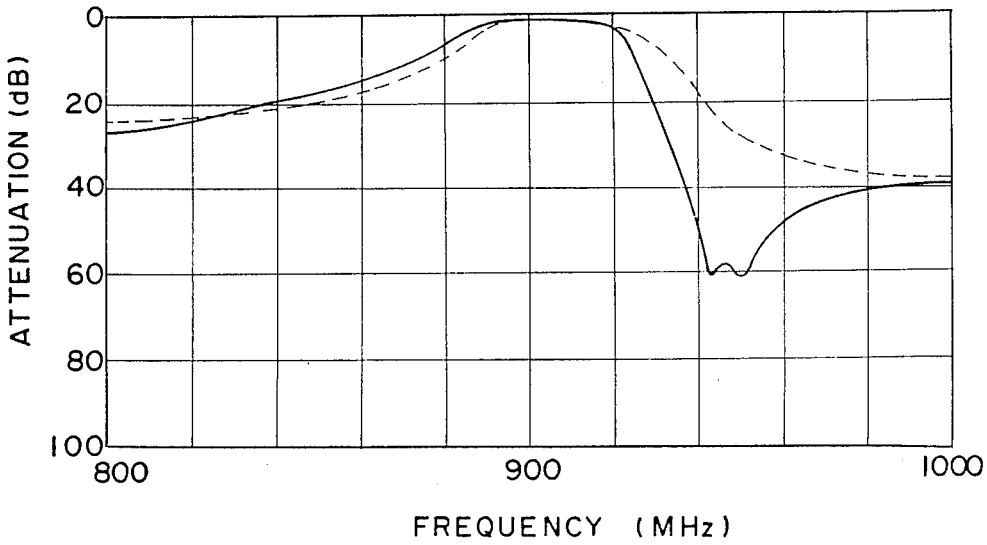
FIG. 30 is a graph showing a frequency characteristic of the dielectric filter of FIG. 29.

Furthermore, FIG. 29 shows a case wherein the first bypass circuit extends from input terminal 7 through a reactance element S to one coupling element, and a second bypass circuit extends from output terminal 8 through a reactance element T to one coupling element. This modification is accomplished by using a metallic pin and bushing fittingly inserted into the coupling hole. The frequency characteristic of the circuit of FIG. 29 is shown in FIG. 30.

In any one of the above described modifications, one or more poles appear in the regions above and/or below the center frequency so that an excellent frequency attenuation can be obtained in such regions. Also, the number of poles may be changed depending on the structure of the bypass circuits.

The present invention is applicable not only to the dielectric filters comprising a block of dielectric resonators as explained in the embodiments, but also to dielectric filters defined by a plurality of dielectric resonators prepared separately. In such a case, the independent dielectric coaxial resonators are connected to each other using a coupling element such as a capacitor.

As has been fully described, a dielectric filter according to the present invention can provide a pole or poles in a frequency region adjacent the center frequency. Thus, it is posssible to provide a band-pass filter, having a frequency characteristic in a desired format, without any increase in the number of stages of the dielectric resonators.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators wherein each said coupling means is defined by a second-typehole formed extending into said main face between a respective pair of said first-type through holes; and at least one bypass circuit means separate from said coupling means, having a reactance component, connected between at least two of said second-type holes.

2. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators; and at least one bypass circuit means, having a reactance component, connected between at least two of said coupling means;

wherein each said coupling means is defined by a second-type hole formed extending into said main face between a respective pair of said first-type through holes; and wherein said bypass circuit means comprises:

first and second bushings made of electrically non-conductive material inserted into said second-type holes, respectively;

metallic pins having portions thereof inserted into said first and second busings, respectively; and printed circuit means with an elongated electrode for electrically connecting said metallic pins.

3. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators wherein each said coupling means is defined by a second-type hole formed extending into said main face between a respective pair of said first-type through holes; and at least one bypass circuit means separate from said coupling means, having a reactance component, connected between at least one second-type hole and at least one dielectric resonator which is other than one of said pair of neighboring dielectric rsonators located immediately adjacent said at least one second-type hole.

4. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators; and at least one bypass circuit means, having a reactance component, connected between at least one coupling means and at least one dielectric resonator which is other than one of said pair of neighboring dielectric resonators located immediately adjacent said at least one coupling means;

wherein each said coupling means is defined by a second-type hole formed extending into said main face between a respective pair of said first-type through holes; and wherein said bypass circuit means comprises:

first and second bushings made of electrically nonconductive material inserted into said second-type hole and first-type through hole, respectively;

metallic pins having portions thereof inserted into said first and second bushings, respectively; and printed circuit means with an elongated electrode for electrically connecting said metallic pins.

5. A dielectric filter as claimed in claim 4, wherein said printed circuit means has capacitors formed therein.

6. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators wherein each said coupling means is defined by a second-type hole formed extending into said main face between a respective pair of said first-type through holes;

first terminal means connected through a coupling capacitor to a first one of said dielectric resonators;

second terminal means connected through a coupling capacitor to a last one of said dielectric resonators; and at least one bypass circuit means separate from said coupling means, having a reactance component, connected between said first terminal means and at least one of: one said second-type hole, and a dielectric resonator which is other than said first and said last dielectric resonators.

7. A dielectric filter comprising:

at least three dielectric resonators coupled in a cascade manner, said resonators being arranged in a unit defined by a single block made of dielectric material having at least three first-type through holes extending into a main face thereof, an inner conductor deposited on an inner face of each said first-type through hole, and an outer conductor deposited at least on an outer face of said block other than said main face thereof, each dielectric resonator being defined by one said inner conductor, by said dielectric material provided therearound, and by said outer conductor;

at least two coupling means, each formed between a pair of neighboring dielectric resonators;

first terminal means connected through a coupling capacitor to a first one of said dielectric resonators;

second terminal means connected through a coupling capacitor to a last one of said dielectric resonators; and at least one bypass circuit means, having a reactance component, connected between said first terminal means and at least one of: one said coupling means, and a dielectric resonator which is other than said first and said last dielectric resonators;

wherein each said coupling means is defined by a second-type hole formed extending into said main face between a respective pair of said first-type through holes; and wherein said bypass circuit means comprises:

first and second bushings made of electrically nonconductive material inserted, respectively, into said first-type through hole of said first one of said dielectric resonators, and at least one of: said second-type hole of said one coupling means, and said first-type through hole of said dielectric resonator which is other than said first and said last dielectric resonators;

metallic pins having portions thereof inserted into said first and second bushings, respectively; and printed circuit means with an elongated electrode for electrically connecting said metallic pins.

8. A dielectric filter as claimed in claim 6, further comprising at least one bypass circuit means separate from said coupling means, having a reactance component, connected between said second terminal means and at least one of: one said second-type hole, and a dielectric resonator which is other than said first and said last dielectric resonators.

* * * * *